US005113058A

United States Patent [19]

Srubas et al.

[11] Patent Number: 5,113,058

[45] Date of Patent: May 12, 1992

[54] PCT HEATER CABLE COMPOSITION AND METHOD FOR MAKING SAME

[75] Inventors: Robert C. Srubas, Granby, Conn.; William M. Rowe, Jr., DeKalb, Miss.

[73] Assignee: Specialty Cable Corp., Wallingford, Conn.

[21] Appl. No.: 531,883

[22] Filed: Jun. 1, 1990

[51] Int. Cl.[5] ..... H05B 3/10

[52] U.S. Cl. ..... 219/548; 219/528; 219/549; 219/553; 252/510; 252/511; 29/611

[58] Field of Search ..... 219/548, 549, 528, 553; 264/104, 105, 22, 27; 252/510, 511; 29/611, 620

[56] References Cited

U.S. PATENT DOCUMENTS

| | | | |
|---|---|---|---|
| 3,914,363 | 10/1975 | Bedard et al. | 264/105 |
| 4,286,376 | 9/1981 | Smith-Johannsen et al. | 29/611 |
| 4,327,480 | 5/1982 | Kelly | 219/528 |
| 4,426,339 | 1/1984 | Kamath et al. | 264/22 |
| 4,668,857 | 5/1987 | Smuckler | 219/549 |
| 4,783,587 | 11/1988 | Ishii et al. | 219/548 |
| 4,866,253 | 9/1989 | Kamath et al. | 219/548 |
| 4,908,156 | 3/1990 | Dalle et al. | 219/549 |

OTHER PUBLICATIONS

Wire and Cable-Union Carbide DFD-6005 Natural Union Carbide Co.

*Primary Examiner*—Bruce A. Reynolds
*Assistant Examiner*—Tu Hoang
*Attorney, Agent, or Firm*—St. Onge Steward Johnston & Reens

[57] ABSTRACT

A self-temperature regulating heater cable using a PTC polymeric matrix is described. A commercially available low density polyethylene is combined with a desired carbon black so as to enable a continuous extrusion at an elevated temperature while enabling residual heat in the extruded PTC layer to anneal the layer to a desired low resistivity in a short time period before quenching. The polyethylene is of the DFD-6005 type in which the amount of molecules whose molecular weight does not exceed about 23,000 is less than about eight percent by weight. The carbon black preferably is a low structure, low resistivity, non-surface treated, conductive carbon black.

22 Claims, 1 Drawing Sheet

PCT HEATER CABLE COMPOSITION AND METHOD FOR MAKING SAME

FIELD OF THE INVENTION

Field Of The Invention

This invention relates to a self-temperature regulating heater cable using a positive temperature coefficient of resistance material and a method for making same.

BACKGROUND OF THE INVENTION

Self-temperature regulating heater cables formed with positive temperature coefficient (PTC) of resistance characteristics are known in the art. Typically, such cable is made with a PTC composition formed of a polymeric matrix through which a carbon black is distributed. A PTC composition is usually formed by commencing with a mixture of a desired carbon black with a copolymer capable of blending with carbon black powder. A polyethylene polymer is then added and mixed with the blended carbon black and a filler material such as a flame retardant. The final blend is then formed into pellets for subsequent use in an extruder to extrude a layer of the PTC material around one or several conductors.

The specific composition of the PTC material is often selected to meet particular criteria for the PTC material or to enhance the efficiency of its manufacture. One area of interest has addressed the separate heating or annealing step that is often required to achieve a desired lower resistance in the PTC material. After annealing, the PTC material is subjected to a cross-linking step by way of an irradiation treatment to stabilize the composition.

For example, in U.S. Pat. No. 4,277,673 to Kelly, PTC compositions are described with which annealing times are reduced by selecting a high resistivity carbon black. The annealing time is stated to be reduced from 64 hours, when a conductive carbon black such as Cabot Corporation's Vulcan XC72 is used with a polyethylene such as DFD 6005, down to five hours when a Cities Service Co.'s (Columbia Chemical) Raven 1255 carbon black is used. There are many different carbon blacks available from commercial sources such as The Cabot Corporation under its trademarks Black Pearl, Vulcan, Monarch, Regal and Elftex or The Columbian Chemical Corporation under its trademark Raven, and from many other companies. Performance data on these carbon blacks are published with various characteristics.

Further reductions in anneal times have been achieved as described in U.S. Pat. No. 4,668,857 to Smuckler. This patent describes a conductive polymeric carbon black composition using a polymer with a melt flow index of at least 1.0 in order to achieve desired conductivities with either no annealing or with as short an annealing time as from one to five minutes.

U.S. Pat. No. 4,818,439 to Blackledge et al. proposes a carbon black loaded polymer material with which annealing is obtained in the short travel time from the extrusion head to a quenching water trough. An anneal time as short as about 42 milliseconds is described as achieving a desired conductivity when the polymeric matrix of the PTC composition is an olefine polymer having a low average molecular weight and a high proportion of molecules having a number average molecular weight below 23,000, generally requiring blends of polymeric materials. In this patent a control PTC composition, using DFD 6005 polyethylene made by Union Carbide Corporation as the polymeric matrix, is described as requiring an unacceptably long anneal time to develop the required PTC properties, e.g., from one to three minutes of annealing.

SUMMARY OF THE INVENTION

With a PTC composition in accordance with the invention, very short anneal times can be achieved while using well known low density polyethylene materials without special polymer additions. High speed manufacturing can be achieved without batch processing and thus dispensing with annealing ovens used for separate special annealing.

These advantages are obtained by the provision of a PTC composition in which the polymeric matrix comprises low density polyethylene polymer of defined characteristics as the primary polymer relied upon to create the PTC effect and in which the carbon black dispersed therein comprises a conductive carbon black that has a low structure, low resistivity, and has not been surface treated.

As described herein for one embodiment in accordance with the invention, the carbon black is selected from a particularly effective group. The carbon blacks that have been found particularly effective enable one to extrude a PTC layer on a conductor while annealing in a continuous manner by reliance upon the residual heat within the extruded layer. High extrusion speeds can be achieved with a residual heat annealing of this type occurring in short time periods as small as from about 3.5 to generally less than about 20 seconds. The resistivity of the extruded polymeric matrix at room temperature is within a desired range while the material exhibits satisfactory PTC behavior.

A particularly surprising aspect of the invention is that one low density polyethylene useful for the invention, the aforementioned DFD 6005, has been described in the prior art as requiring long anneal times but has been discovered herein to be capable of yielding satisfactory resistivity levels with very short annealing times when combined with a selected carbon black.

The short anneal times obtained as described herein with a DFD 6005-type polyethylene enables a continuous manufacturing process. This achievement may be attributed to the combination of the DFD 6005-type polyethylene with a carbon black that has a low structure (i.e. with a relatively low oil, DBP absorption), low resistivity and is conductive and has not been surface treated.

It is, therefore, an object of the invention to provide a self-regulating heating cable formed with a PTC material and a method of manufacturing such cable.

These and other advantages and objects of the invention can be understood from the following detailed description of the invention in conjunction with the drawing.

DETAILED DESCRIPTION OF DRAWING

Figure 1:
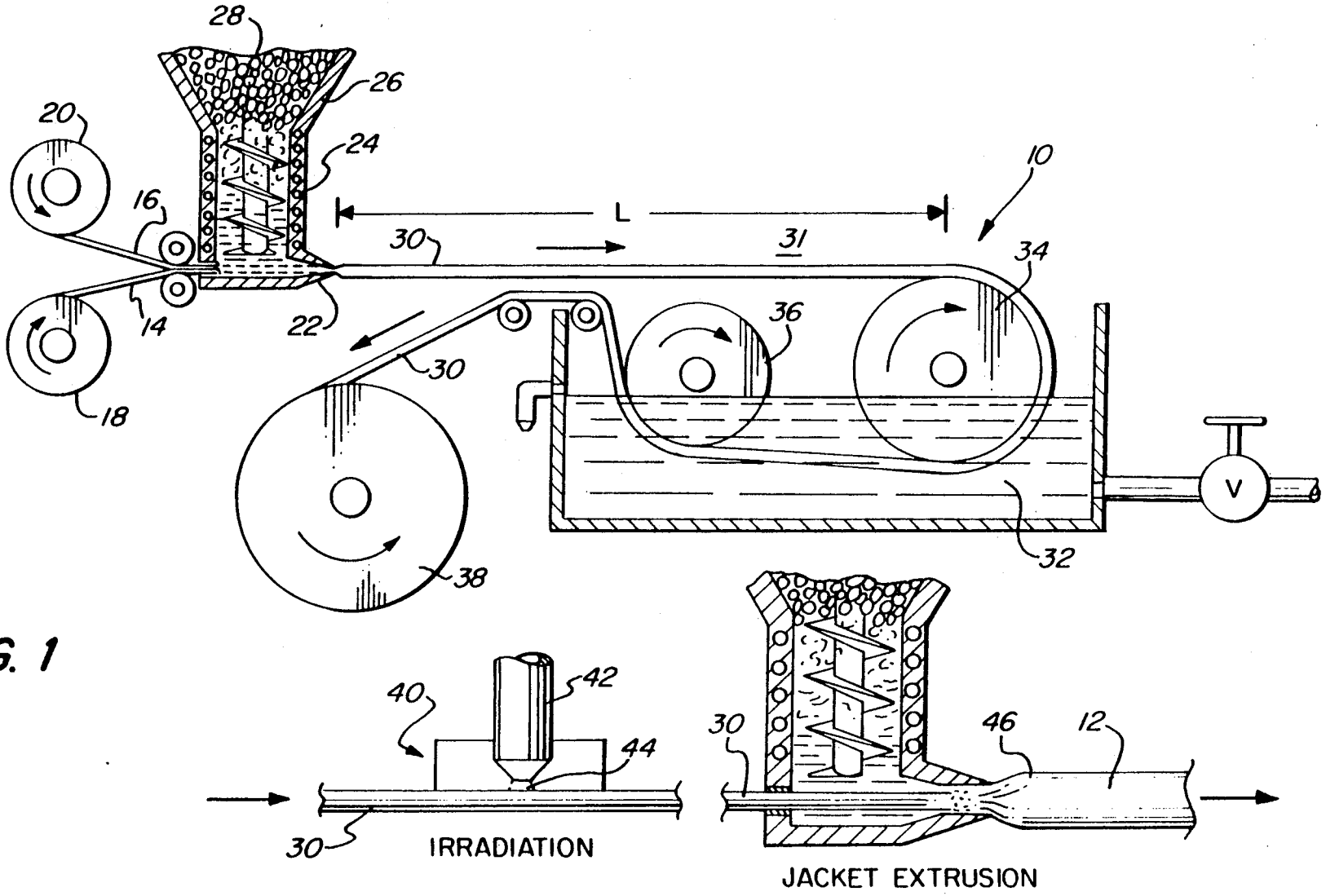
FIG. 1 is a schematic representation of a manufacturing process for making a self-regulating heater cable using a PTC material.

With reference to FIG. 1, a process 10 is shown for making a self-regulating PTC heater cable 12 in accordance with the invention. In the drawing, a pair of spaced-apart, parallel conductors 14, 16 are drawn from supply reels 18, 20 and fed through an extrusion head 22 to commence a dog-bone type of heater cable construction. It should be understood, however, that the invention is not limited to this type of heater cable which can be of the coaxial type or use conductors which are first helically wound on fiber cores such as dacron or the like. The type of cable shown in FIG. 1 is thus selected to illustrate the invention.

The extrusion head 22 is at the bottom of a heated extruder 24 of a conventional type and has a hopper 26 for receiving a supply of polymeric matrix material 28 in pellet form.

The PTC material is formed in a manner that is generally well known in the industry for making PTC extrudable matrices. Typically, because the primary polymeric matrix, polyethylene, has a high crystallinity, an initial mixture of a co-polymer and a desired carbon black is made and a low density crystalline polyethylene is thereafter added to the mixture. A filler, such as a fire resistant material, may be added, such as for personal comfort heater cables, and upon its mixture with the other ingredients, the final mixture is pelletized in the form shown at 28 in FIG. 1.

The carbon black used in the PTC matrix is of a type that enhances conductivity after extrusion and with a very short anneal time. Various conductive carbon blacks have been found suitable, provided they are of a low resistivity type and have low structure, i.e., an oil DBP absorption of less than 100 cc/100 grams and preferably of the order of 60 cc per 100 grams. The carbon black should not be surface-treated since surface treatment tends to increase resistivity. Generally, such carbon blacks which also exhibit a ratio of their surface area A in $m^2$/gram to their oil absorption x in cc/100 gram in the range of $0.6 \leqq A/x \leqq 1.75$ were found usable in achieving an effective PTC material with very low anneal times after extrusion by reliance upon the residual heat within the extruded PTC material.

The polyethylene used in the PTC matrix in accordance with the invention should be of the low density type with a crystallinity, as determined by x-ray diffraction, of at least 20 percent and preferably about 30 percent or higher.

Characterization of a suitable low density polyethylene can be made with reference to its number average and weight average molecular weights. A good description of these characteristics and how they are measured is found in an article entitled, "Polyethylene in Wire and Cable Use—Effect of Molecular Structure on Properties" by W. W. Sporn and H. J. Frey and published at a Symposium on Polyethylene by the American Institute of Electrical Engineers in New York, N.Y. about Jan. 22, 1957.

A particularly suitable low density polyethylene is DFD 6005 made by the Polyolefins Division of Union Carbide. This polymer has a fractional melt index of 0.20 that is less than 1.0 and a relatively high molecular weight. It has been reported, for example, that analysis of the samples of DFD 6005 showed a weight average molecular weight ($M_w$) of about 124,000 and 139,000 and number average molecular weight ($M_n$) of 30,000 to about 34,800, respectively. The amount of molecules having a molecular weight of less than 23,000 is generally about seven percent in DFD 6005 (See U.S. Pat. No. 4,818,439).

As published by its manufacturer, DFD 6005 contains a non-staining antioxidant, has a dielectric constant at 1 MHz of 2.28, a dissipation factor at 1 MHz of 0.0002, a dielectric strength at 125 mils thickness of 550 V/mill and $2.17 \times 10^7$ volts/m, a volume resistivity of greater than $1 \times 10^{14}$ ohm-meter, a density of 0.92 gm/$cm^3$, a tensile strength of 2,200 psi, an elongation of 600 percent, and a brittleness temperature of −90° C.

Hence, the polyethylenes suitable for a PTC composition in accordance with the invention are low density polyethylene with a crystallinity that is greater than about 20 percent as determined by x-ray diffraction, a number-average molecular weight of at least about 30,000, and having less than about eight percent by weight of polyethylene molecules whose molecular weight does not exceed about 23,000.

Various copolymers can be used to aid in mixing of the carbon black as earlier discussed. Descriptions of such copolymers are extensively set forth in the art and, for example, can be EEA (ethylene ethyl acrylate) or EVA (ethylene vinyl acetate) The filler can be of many forms, also as generally described in the art, and preferably is a flame retardant.

The extrusion of the PTC composition polymeric matrix is done at a temperature that is above the melting point of the various polymer components, yet not so high so that an extruded layer 30 formed over conductors 14, 16 cannot hold its shape. The extrusion temperature typically is about 300° to about 450° F. As shown in FIG. 1, the extruded layer 30 is passed along on ambient air exposed path 31 of length L before being quenched in a water bath 32. A pair of rollers 34, 36 are used to enhance the frictional grip on layer 30 without its deformation during extrusion.

Rollers 34, 36 are shown with different diameters for clarity and illustration though they could be of the same diameter and mounted at different levels. A take-up reel 38 is used to wind the quenched extruded layer 30.

The temperature of the water bath 32 can be as great as 150° F.; it preferably is that of ordinary tap water, say about 55° F.

The length L of air path 31 is selected commensurate with that necessary to enable residual heat within the extruded layer 30 to achieve the required annealing for a desired resistivity of layer 30. The path length L thus varies, being longer for higher speed extrusions. The speed of the extrusion for a fixed path length L can thus be used to achieve maximum conductivity. In one experiment the extrusion speed for a layer 30 in accordance with the invention was varied for a forty foot long path 31 as set forth in Table I.

TABLE I

| Extrusion Line Speed (FPM) | Duration In Air Path 30 (Seconds) | Conductivity ma/10 feet |
|---|---|---|
| 100 | 24 | 170 |
| 200 | 12 | 350 |
| 250 | 10 | 137 |
| 400 | 6 | 67 |
| 500 | 4.5 | 10 |

At an extrusion speed at or about 200 fpm, a desired maximum conductivity is achieved. At higher speeds there is a decrease in conductivity because the required morphological rearrangement to achieve maximum conductivity is not obtained The quench medium 32 precludes further morphological rearrangement by in effect freezing molecular motions Reduced conductivity at line speeds below 200 fpm appears to be a result of excess work imparted to the polymeric matrix 28 during its residence in the extruder.

Generally, annealing is completed in a time period from about 3.5 to about 20 seconds when using the residual heat in an extruded PTC layer whose extrusion temperature is about 300° to about 450° F.

After the extrusion and quenching of layer 30, it is exposed at 40 to an irradiation process to effect a crosslinking. The irradiation step can be by way of an electron beam 42 at an intensity and duration that is optimized for the crossectional mass of the cable 30 as it is passed below the aperture 44 through which the electron beam passes.

When crosslinking is completed, insulation jacket 46 is extruded around the PTC layer 30. The composition of the jacket 46 and its extrusion are well known in the art.

In one example for a PTC composition layer 30 in accordance with the invention, the following ingredients shown in Table II were used.

TABLE II

| Material | Source | Percentage by Weight of Composition |
|---|---|---|
| Copolymer | Elvax (Dupont EVA) | 17% |
| Carbon Black | Raven 1170 Columbian Chemicals | 17% |
| Low Density Polyethylene | DFD 6005 Union Carbide | 46% |
| Flame Retardant | Solem SB 932 | 20% |

Different carbon blacks can be used from that shown in Table II. The carbon blacks listed in Table III have an A/x ratio that falls within the range $0.6 \leqq A/x \leqq 1.75$ while the carbon black Raven 1170 in Table II does not. Raven 1170, therefore, does not yield the optimum conductivity desired when annealing of the polymeric matrix is obtained by relying upon the residual heat within the extruded PTC material prior to quenching.

The volume resistivities in Table III are measured under non-annealing conditions that have been found can be best approximated by molding plaques of these compounds for three minutes at 350° F. When such plaque has a volume resistivity of less than about 1,200 ohm-cm, the material is quite unlikely to require a separate annealing step in manufacture and a heater cable using the PTC compound can be made in accordance with the continuous process shown in and described with reference to FIG. 1.

TABLE III

| Carbon Black 20% | Low Density Polyethylene DFD 6005 % | Copolymer Elvax 470 Percent | Ratio BET/DBP (A/x) | Volume Resistivity Ohm-cm |
|---|---|---|---|---|
| Regal 660 (control)* | 60 | 20 | 1.87 | 6950 |
| Raven 1020** | 60 | 20 | 1.73 | 862 |
| Raven 1000 | 60 | 20 | 1.58 | 528 |
| Regal 330 | 60 | 20 | 1.27 | 456 |
| Regal 99I | 60 | 20 | 0.77 | 518 |

*REGAL carbon blacks are manufactured by the Cabot Corporation of Billerica, Massachusettes. A listing of their specifications is published by the manufacturer and used herein as set forth in TABLE IV.

**RAVEN carbon blacks are manufactured by the Columbian Chemicals, Inc. of Atlanta, Georgia. A listing of their specifications is published by the manufacture and used herein.

TABLE IV

| Carbon Black (Pellets) | Jetness Index | BET Surface Area (A) $m^2/gm$ | DBP Absorption cc/100 gm | A/x | Particle Size NM | Tinting Strength Index | Volatile Content % | Density $lbs/ft^3$ | pH |
|---|---|---|---|---|---|---|---|---|---|
| Regal 330 | 84 | 94 | 70 | 1.27 | 25 | 110 | 1.0 | 28 | |
| Regal 99I | 90 | 46 | 63 | 0.77 | 46 | 92 | 1.0 | 30 | |
| Raven 1000 | 155 | 95 | 60 | 1.58 | 24 | 123 | 1.9 | 29 | 6.0 |
| Raven 1020 | 151 | 95 | 55 | 1.73 | 24 | 121 | 1.5 | 31 | 6.8 |
| Raven 1170 | 162 | 120 | 55 | 2.18 | 22 | 127 | 1.8 | 31 | 5.5 |

This composition layer 30 yielded the conductivities identified in Table I and was found suitable for a PTC self-regulating heater cable with a jacket 46. Generally, an acceptable PTC behavior, after extrusion and crosslinking, should provide a change in resistance as a function of temperature change that is from four to six orders of magnitude over a temperature range from about 20° C. to about 100° C.

The composition shown in Table II can be varied. Different quantities of carbon black can be used. The carbon black can be present in a range from about 14% to about 25%.

Preferably, the copolymer (e.g., Elvax) is present in an amount that is generally the same as the carbon black since the copolymer is used to provide the primary blending of the carbon black.

The low density polyethylene also can be varied in quantity. However, too much polyethylene will inhibit adequate and proper carbon black loading and too little disturbs the PTC effect necessary for a satisfactory heater cable for personal comfort applications such as electric blankets. The low density polyethylene should preferably be in the range from about 35% to about 60 percent.

With PTC compounds as described herein, very low duration anneal times are achieved with commercially available low density polyethylene. This then enables high speed manufacture without a separate batch-type annealing operation.

Having thus described a PTC polymer matrix in accordance with the invention for heater cables, the advantages of the invention can be appreciated. Variations from the described embodiment and illustrations can be made without departing from the scope of the invention.

What is claimed is:

1. In an electrically conductive, self-regulating heater cable formed with a pair of wires that are connected to each other by an elongate extruded layer of self-regulating semi-conductive composition exhibiting a positive temperature coefficient (PTC) of electrical resistance, wherein carbon black is dispersed in an olefinic polymeric matrix, the improvement wherein said polymeric matrix comprises a low density polyethylene polymeric composition having:

(1) a crystallinity greater than about 20% as measured by x-ray diffraction;

(2) a number average molecular weight of at least about 30,000; and (3) less than about 8% by weight of molecules having a molecular weight less than about 23,000, and which is present in said composition in an amount of from about 35 to about 60 percent by weight; and wherein said carbon black comprises a low structure, low resistivity, non-surface treated, conductive carbon black, in an amount of from about 14 to about 15 percent by weight in said composition; so as to reduce the time for annealing by reliance upon residual heat within the extruded PTC composition to less than about 20 seconds.

2. The heater cable as claimed in claim 1 wherein the low density polyethylene has a said crystallinity of at least thirty percent (30%).

3. The heater cable as claimed in claim 1 wherein the carbon black has a BET Nitrogen absorption surface area A in $m^2$/gram and a DBP absorption x in cc/100 grams such that $0.6 \leqq A/x \leqq 1.75$.

4. The heater cable as claimed in claim 3 wherein the carbon black primarily consists of a carbon black selected from the group consisting of Raven 1000, Raven 1020, Regal 330, and Regal 991.

5. The heater cable as claimed in claim 1 and a copolymer formed of a plastic material which accepts the carbon black for blending and is present in an amount from about 14 percent to about 25 percent by weight of the composition.

6. The heater cable as claimed in claim 1 wherein the carbon black primarily consists of Raven 1170 carbon black.

7. The heater cable as claimed in claim 1 wherein the low density polyethylene is DFD-6005.

8. In a method of manufacturing an electrically conductive, self-regulating heater cable formed with a conductors that are connected to each other by an elongate extruded layer of self-regulating semiconductive composition exhibiting a positive temperature coefficient (PTC) of electrical resistance, the improvement comprising the steps of:

extruding a said layer of semiconductive PTC composition containing a carbon black having a low resistivity, is non-surface treated and has a low surface area A in $m^2$/gram and a low structure x in cc/100 grams of DBP oil absorption such that $0.6 \leqq A/x \leqq 1.75$, and further containing a polymeric matrix formed with a low density polyethylene polymer with a crystallinity that is greater than about twenty percent (20%) as determined by x-ray diffraction and which, without an addition of polyethylene having a number-average molecular weight of less than about 30,000, has less than about eight percent (8%) of total polymer weight formed of molecules whose molecular weight does not exceed about 23,000, over an electrical conductor at an elevated extrusion temperature; and exposing the conductor with said extruded layer as they emerge from the extrusion step to a gaseous medium that is at a temperature below the extrusion temperature and for a time selected less than about 20 seconds to enable residual heat within the extruded layer to reduce its resistance per unit length of the extruded layer to a desired value.

9. The method of manufacturing the heater cable as claimed in claim 8 wherein the exposing step has a duration of the order of from about 3.5 to less than about 20 seconds.

10. The method of manufacturing the heater cable as claimed in claim 8 wherein the exposing step comprises a step of passing the conductor with the extruded layer through ambient air for a distance and at a speed selected to enable the residual heat in the layer to reduce the resistance per unit length of the extruded layer to said desired value.

11. The method of manufacturing the heater cable as claimed in claim 10 wherein the step of passing the conductor with its extruded layer through air is terminated with a step of quenching the conductor with its extruded layer by wetting them with a liquid at a substantially lower temperature than the elevated extrusion temperature.

12. The method of manufacturing the heater cable as claimed in claim 11 wherein the step of quenching comprises a step of passing the conductor with its extruded layer through a liquid bath.

13. The method of manufacturing the heater cable as claimed in claim 10 wherein the speed, at which said conductor with the extruded layer emerges from the extrusion step and passes through the gaseous medium in the exposing step, is in the range from about 150 to about 1,000 feet per minute.

14. The method of manufacturing the heating cable as claimed in claim 8 and further comprising the step of:

forming a pre-extrusion composition containing a polymeric matrix in which said carbon black is dispersed wherein the carbon black is a low structure, low resistivity, non-surface treated, conductive carbon black in an amount from about 14 percent to about 25 percent by weight of the composition.

15. The method of manufacturing the heating cable as claimed in claim 14 wherein the carbon black is selected from the group consisting of Raven 1000, Raven 1020, Regal 330, Regal 991.

16. The method of manufacturing the heating cable as claimed in claim 15 wherein the low density polyethylene is DFD-6005.

17. The method of manufacturing the heating cable as claimed in claim 15 wherein the polymeric matrix includes a copolymer formed of a plastic material which accepts the carbon black for blending and is present in an amount from about 14 percent to about 25 percent by weight of the composition.

18. The method of manufacturing the heating cable as claimed in claim 17 wherein the filler PTC composition includes a fire resistant filler material in an amount from about 15 percent to about 25 percent by weight of the composition.

19. In a method of manufacturing an electrically conductive, self-regulating heater cable formed with a pair of spaced-apart, generally parallel wires that are connected to each other by an elongate extruded layer of self-regulating semiconductive composition exhibiting a positive temperature coefficient (PTC) of electrical resistance, the improvement comprising the steps of:

extruding, at an extrusion temperature, a said layer of semiconductive PTC composition, having a resistance per unit length, containing a polymeric matrix formed with a low density polyethylene polymer with a crystallinity that is greater than about twenty percent (20%) as determined by x-ray diffraction and which, without an addition of polyethylene having a number-average molecular weight of less than about 30,000, has less than about eight percent (8%) of total polymer weight formed of molecules whose molecular weight does not exceed about 23,000, over said spaced-apart wires at said extrusion temperature; and exposing the wires with said extruded layer of self-regulating semiconductive PTC composition as these emerge from the extrusion step to a gaseous medium that is at a temperature below the extrusion temperature and for a time selected less than about 20 seconds to enable residual heat within the extruded layer to reduce the resistance per unit length of the extruded layer to a desired value.

20. A method for manufacturing an electrically conductive self-temperature regulating heater cable comprising the steps of:

extruding around a pair of spaced-apart conductors and at an extrusion temperature a layer of self-temperature regulating semi-conductive positive temperature coefficient of resistance composition containing carbon black that is dispersed in a polymeric matrix;

wherein the polymeric matrix includes a low density polyethylene polymer with a crystallinity that is greater than about twenty percent (20%) as determined by x-ray diffraction and is present in an amount from about 35 percent to about 60 percent by weight of the composition;

wherein the carbon black comprises a low structure, low resistivity, non-surface treated, conductive carbon black whose nitrogen surface area, A as measured in $m^2$/gram and whose DBP absorption x in cc/100 grams are such that $0.6 \leqq A/x \leqq 1.75$ and is present in an amount from about 14 percent to about 25 percent of the composition;

passing the conductors with the extruded PTC layer as these emerge from the extrusion step along a path that is exposed to a gas at a lower temperature than the extrusion temperature for a path length and at a speed that is selected to enable residual heat inside the extruded layer to reduce resistivity of the extruded layer to a desired value;

passing the conductors with the extruded PTC layer through a medium so as to quench the PTC layer to lower its temperature and physically stabilize dimensions of the extruded layer;

radiating the conductors with the extruded PTC layer to cause a cross linking of the PTC layer; and extruding an insulating jacket around the PTC layer.

21. A method for manufacturing an electrically conductive self-temperature regulating heater cable comprising the steps of:

extruding around a conductor and at an extrusion temperature a layer of self-temperature regulating semi-conductive positive temperature coefficient of resistance composition containing carbon black that is dispersed in a polymeric matrix;

wherein the polymeric matrix includes a low density polyethylene polymer with a crystallinity that is greater than about twenty percent (20%) as determined by x-ray diffraction and is present in an amount from about 35 percent to about 60 percent by weight of the composition;

wherein the carbon black comprises a low structure, low resistivity, non-surface treated, conductive carbon black whose nitrogen surface area, A as measured in $m^2$/gram and whose DBP absorption x in cc/100 grams are such that $0.6 \leqq A/x \leqq 1.75$ and is present in an amount from about 14 percent to about 25 percent of the composition;

passing the conductor with the extruded PTC layer as these emerge from the extrusion step along a path that is exposed to a gas at a lower temperature than the extrusion temperature for a path length and at a speed that is selected to enable residual heat inside the extruded layer to reduce resistivity of the extruded layer to a desired value;

passing the conductor with the extruded PTC layer through a medium so as to quench the PTC layer to lower its temperature and physically stabilize dimensions of the extruded layer;

irradiating the conductor with the extruded PTC layer to cause a cross linking of the PTC layer, helically wrapping a second conductor around and in electrical contact with the PTC layer; and extruding an insulating jacket around the second conductor.

22. An electrically conductive, self-regulating heater cable formed with conductors that are connected to each other by an elongate extruded layer of self-regulating semi-conductive composition exhibiting a positive temperature coefficient of electrical resistance and which contains carbon black dispersed in a polymeric matrix wherein the improvement comprises:

a polymeric matrix having a principal polymer material relied upon for the positive temperature coefficient is DFD-6005 polyethylene; and wherein the carbon black is a low structure, low resistivity, non-surface treated, conductive carbon black in an amount from about 14 percent to about 25 percent by weight of the composition; so as to reduce the time for annealing by reliance upon residual heat within the extruded layer to less than about 20 seconds.

* * * * *

UNITED STATES PATENT AND TRADEMARK OFFICE

CERTIFICATE OF CORRECTION

PATENT NO. : 5,113,058

DATED : May 12, 1992

INVENTOR(S) : ROBERT C. SRUBAS and WILLIAM M. ROWE, JR.

It is certified that error appears in the above-identified patent and that said Letters Patent is hereby corrected as shown below:

Column 7, line 10, after "about", delete --15--, and insert --25--.

Signed and Sealed this

Sixth Day of July, 1993

*Attest:*

Michael K. Kirk

MICHAEL K. KIRK

*Attesting Officer*

*Acting Commissioner of Patents and Trademarks*

UNITED STATES PATENT AND TRADEMARK OFFICE

CERTIFICATE OF CORRECTION

PATENT NO. : 5,113,058

DATED : May 12, 1992

INVENTOR(S) : ROBERT C. SRUBAS and WILLIAM M. ROWE, JR.

It is certified that error appears in the above-identified patent and that said Letters Patent is hereby corrected as shown below:

Title page, item [54] and column 1, line 2, delete the first word, "PCT" and insert --PTC--.

Signed and Sealed this

Thirty-first Day of August, 1993

*Attest:*

*Attesting Officer*

BRUCE LEHMAN

*Commissioner of Patents and Trademarks*